US010107177B1

(12) United States Patent
Ahmed et al.

(10) Patent No.: US 10,107,177 B1
(45) Date of Patent: Oct. 23, 2018

(54) ACTIVE THERMAL MANAGEMENT IN A TOW/HAUL MODE

(71) Applicant: GM GLOBAL TECHNOLOGY OPERATIONS LLC, Detroit, MI (US)

(72) Inventors: Sami Ahmed, Orion Township, MI (US); Luca Scavone, Moncalieri (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/653,124

(22) Filed: Jul. 18, 2017

(51) Int. Cl.

| | |
|---|---|
| ***F01P 7/16*** | (2006.01) |
| ***F01P 3/02*** | (2006.01) |
| ***F01P 3/20*** | (2006.01) |
| ***F01P 5/10*** | (2006.01) |
| ***F01P 11/16*** | (2006.01) |
| ***F02M 26/22*** | (2016.01) |
| ***F02M 35/10*** | (2006.01) |
| ***F02B 39/00*** | (2006.01) |
| *F01P 7/14* | (2006.01) |

(52) U.S. Cl.
CPC ..... *F01P 7/165* (2013.01); *F01P 3/02* (2013.01); *F01P 3/20* (2013.01); *F01P 5/10* (2013.01); *F01P 11/16* (2013.01); *F02B 39/005* (2013.01); *F02M 26/22* (2016.02); *F02M 35/10268* (2013.01); *F01P 2003/021* (2013.01); *F01P 2003/024* (2013.01); *F01P 2007/146* (2013.01); *F01P 2025/32* (2013.01); *F01P 2025/40* (2013.01); *F01P 2025/46* (2013.01); *F01P 2037/00* (2013.01)

(58) Field of Classification Search
CPC ..... F01P 7/165; F01P 7/16; F01P 7/14; F01P 2007/143; F01P 2007/146; F01P 7/167; F01P 3/20; F01P 2025/08; F01P 2025/30; F01P 2025/32; F01P 2025/40; F01P 2025/46; F01P 2025/50
See application file for complete search history.

(56) References Cited

U.S. PATENT DOCUMENTS

2016/0290216 A1* 10/2016 Katragadda ..... F01P 11/16

* cited by examiner

*Primary Examiner* — Jacob Amick
(74) *Attorney, Agent, or Firm* — Lorenz & Kopf, LLP

(57) ABSTRACT

An active thermal management system for a vehicle and a method of operating the system are provided. The active thermal management system may include, but is not limited to, an exhaust gas temperature sensor, an engine metal temperature sensor, an engine coolant output temperature sensor, an engine oil temperature sensor, a cooling system, and a controller, the controller configured to determine when the vehicle is in a tow/haul mode, operate the cooling system when at least one of the temperature of the exhaust gas, the engine metal, the coolant output from the engine and the temperature of the engine oil is greater than a predetermined temperature, and operate the cooling system to bypass a radiator when all of the temperature of the exhaust gas, the engine metal, the temperature of the coolant, and the temperature of the engine oil is lower than a predetermined low temperature.

20 Claims, 3 Drawing Sheets

ACTIVE THERMAL MANAGEMENT IN A TOW/HAUL MODE

INTRODUCTION

The present invention generally relates to a vehicle, and more particularly relates to vehicle component cooling systems.

Some vehicles are designed to excel at towing or hauling heavy modes. These vehicles may be equipped with a tow/haul mode that improves the towing or hauling performance of the vehicle by, for example, changing shift points for a transmission. However, towing or hauling heavy loads can stress on an engine.

Accordingly, it is desirable to reduce the stress on an engine when the vehicle is towing or hauling a heavy load. Furthermore, other desirable features and characteristics of the present invention will become apparent from the subsequent detailed description of the invention and the appended claims, taken in conjunction with the accompanying drawings and the background of the invention.

SUMMARY

In one embodiment, for example, an active thermal management system for a vehicle is provided. The active thermal management system may include, but is not limited to, an exhaust gas temperature sensor configured to output a temperature of exhaust gas of the vehicle, an engine metal temperature sensor configured to output a temperature of engine metal of an engine of the vehicle, an engine coolant output temperature sensor configured to output a temperature of coolant output from the engine of the vehicle, an engine oil temperature sensor configured to output a temperature of engine oil of the vehicle, a cooling system including, but not limited to, a radiator configured to cool a coolant, a plurality of fluid transmission lines configured to transport the coolant, a main pump configured to circulate the coolant, and at least one valve, and a controller communicatively coupled to the exhaust gas temperature sensor, the engine metal temperature sensor, the engine coolant output temperature sensor, the engine oil temperature sensor and the at least one valve, the controller configured to determine when the vehicle is in a tow/haul mode, operate, when the vehicle is in the tow/haul mode, the at least one valve to circulate coolant through the radiator when at least one of the temperature of the exhaust gas is greater than a predetermined high exhaust gas temperature, the temperature of engine metal of the vehicle is greater than a predetermined high engine metal temperature, the temperature of the coolant output from the engine of the vehicle is greater than a predetermined high coolant output temperature, and the temperature of the engine oil of the vehicle is greater than a predetermined high engine oil temperature, and operate, when the vehicle is in the tow/haul mode, the at least one valve to bypass the radiator when all of the temperature of the exhaust gas is lower than a predetermined low exhaust gas temperature, the temperature of engine metal of the vehicle is lower than a predetermined low engine metal temperature, the temperature of the coolant output from the engine of the vehicle is lower than a predetermined low coolant temperature, and the temperature of the engine oil of the vehicle is lower than a predetermined low engine oil temperature.

In another embodiment, for example, a vehicle is provided. The vehicle may include, but is not limited to, an exhaust gas temperature sensor configured to output a temperature of exhaust gas of the vehicle, an engine metal temperature sensor configured to output a temperature of engine metal of an engine of the vehicle, an engine coolant output temperature sensor configured to output a temperature of coolant output from the engine of the vehicle, an engine oil temperature sensor configured to output a temperature of engine oil of the vehicle, a cooling system including, but not limited to a radiator configured to cool a coolant, a plurality of fluid transmission lines configured to transport the coolant, a main pump configured to circulate the coolant, and at least one valve, and a controller communicatively coupled to the exhaust gas temperature sensor, the engine metal temperature sensor, the engine coolant output temperature sensor, the engine oil temperature sensor and the at least one valve, the controller configured to determine when the vehicle is in a tow/haul mode, operate, when the vehicle is in the tow/haul mode, the at least one valve to circulate coolant through the radiator when at least one of the temperature of the exhaust gas is greater than a predetermined high exhaust gas temperature, the temperature of engine metal of the vehicle is greater than a predetermined high engine metal temperature, the temperature of the coolant output from the engine of the vehicle is greater than a predetermined high coolant output temperature, and the temperature of the engine oil of the vehicle is greater than a predetermined high engine oil temperature, and operate, when the vehicle is in the tow/haul mode, the at least one valve to bypass the radiator when all of the temperature of the exhaust gas is lower than a predetermined low exhaust gas temperature, the temperature of engine metal of the vehicle is lower than a predetermined low engine metal temperature, the temperature of the coolant output from the engine of the vehicle is lower than a predetermined low coolant temperature, and the temperature of the engine oil of the vehicle is lower than a predetermined low engine oil temperature.

In yet another embodiment, for example, a method for operating an active thermal management system for a vehicle is provided. The method may include, but is not limited to, determining, by a controller, when the vehicle is in a tow/haul mode, operating, when the vehicle is in the tow/haul mode, at least one valve to circulate coolant through a radiator when at least one of a temperature of an exhaust gas is greater than a predetermined high exhaust gas temperature, a temperature of engine metal of the vehicle is greater than a predetermined high engine metal temperature, a temperature of the coolant output from an engine of the vehicle is greater than a predetermined high coolant output temperature, and a temperature of an engine oil of the vehicle is greater than a predetermined high engine oil temperature, and operating, when the vehicle is in the tow/haul mode, the at least one valve to bypass the radiator when all of the temperature of the exhaust gas is lower than a predetermined low exhaust gas temperature, the temperature of engine metal of the vehicle is lower than a predetermined low engine metal temperature, the temperature of the coolant output from the engine of the vehicle is lower than a predetermined low coolant temperature, and the temperature of the engine oil of the vehicle is lower than a predetermined low engine oil temperature.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

Figure 1:
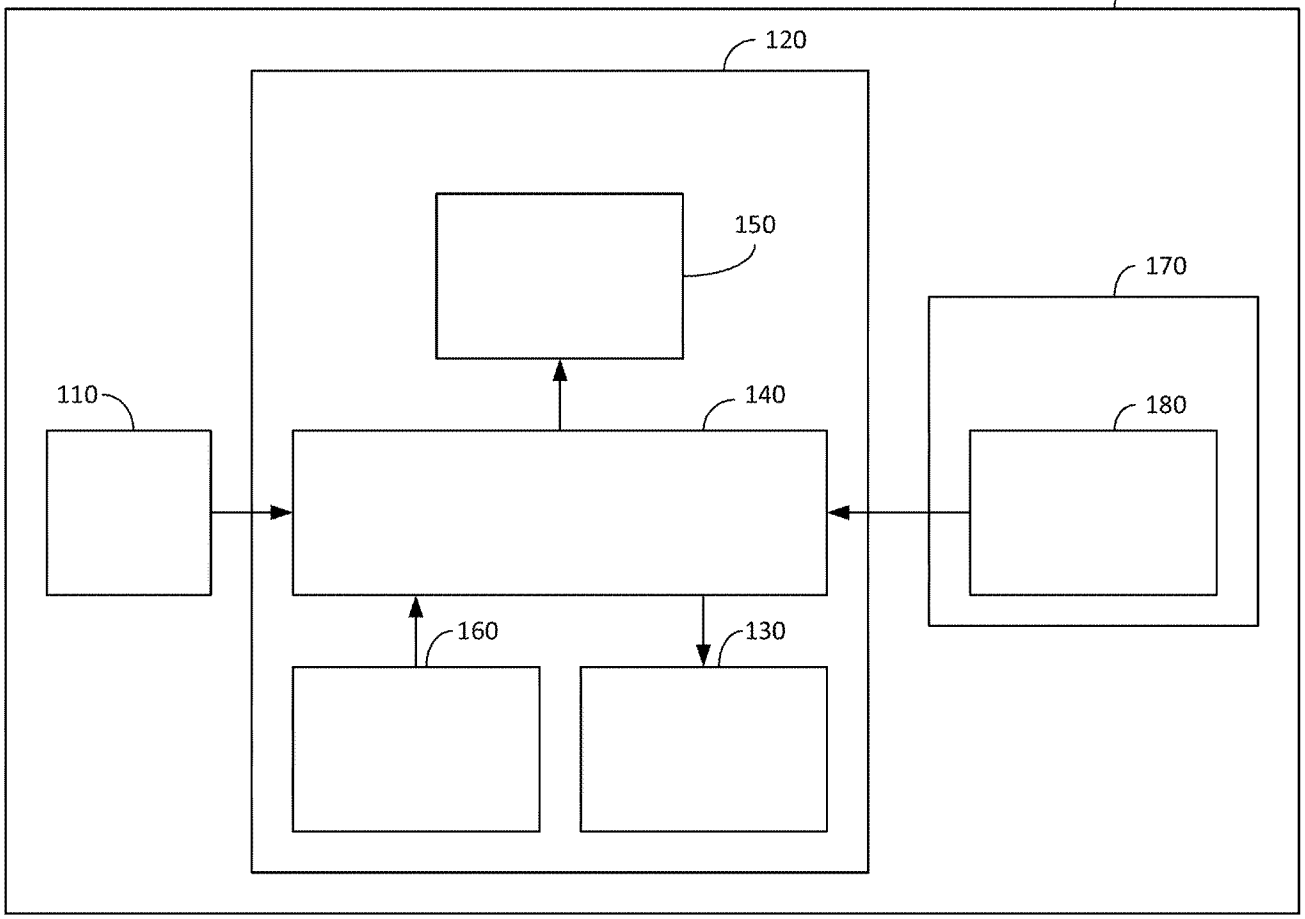
FIG. 1 is a block diagram of a vehicle, in accordance with an embodiment.

FIG. 1 is a block diagram of a vehicle 100, in accordance with an embodiment. The vehicle 100 may be, for example, an automobile, an aircraft (e.g., airplane, a helicopter, etc.), a watercraft, or the like. The vehicle 100 may be used to tow or haul a heavy load. The load may be, for example, a trailer, a boat, rocks, another vehicle or anything else which could be loaded in the vehicle 100, or in a bed of the vehicle when the vehicle is a truck, or towed by the vehicle 100. When towing or hauling a heavy load, a user of the vehicle 100 may activate a tow/haul mode utilizing a tow/haul interface 110. The tow/haul interface 110 may be a button, knob or the like on a dashboard, on a stock surrounding a steering wheel, on a steering wheel or the like. The tow/haul interface 110 may activate a tow/haul mode for the vehicle 100 which alters one or more components of the vehicle 100 to aid the vehicle 100 in towing or hauling a heavy load. For example, the tow/haul mode may change a transmission control module gear pattern to maintain engine at high revolutions per minute (RPM) in order to increase the power of the engine or provide extra braking capability.

The tow/haul mode may also activate an active thermal management system 120. The active thermal management system 120 utilizes a cooling system 130 to cool one or more components of the vehicle 100 to aid the vehicle 100 in towing or hauling a heavy load. As discussed in further detail below, the active thermal management system 120 increases the durability and increases the protection for engine hardware by lowering the temperatures of the engine components during extreme towing conditions and can reduce or eliminate required engine idle times at the end of a drive cycle.

The active thermal management system 120 includes a controller 140. The controller 140 may be a central processing unit (CPU), an application specific integrated circuit (ASIC), a field programmable logic array (FPGA), a microcontroller, or any other logic device or combination thereof. The controller 140 may be dedicated to the active thermal management system 120 or may be shared by one or more other systems in the vehicle 100.

The active thermal management system 120 also includes memory 150. The memory 150 may be any combination of volatile and non-volatile memory. The memory 150 may dedicated to the active thermal management system 120, or shared with one or more other systems in the vehicle 100. Furthermore, the memory 150 may be located within the vehicle 100, may be a remote cloud based memory, or a combination thereof. The memory 150 may store non-transitory computer readable instructions, which when executed by the controller 140, implement the active thermal management system 120, as discussed in further detail below.

The active thermal management system 120 further includes multiple temperature sensors 160. The temperature sensors 160 may include, for example, one or more engine metal temperature sensors, engine coolant output sensors, engine oil temperatures, engine inlet temperature sensor or the like. As discussed in further detail below, the controller 140 may utilize the temperature data output by the temperature sensors 160 to engage the cooling system 130 to cool components of the vehicle 100.

The temperature sensors 160 may be, for example, in the path of the cooling system 130 or coupled to components which are cooled by the cooling system. However, the active thermal management system 120 may also receive temperature data from components elsewhere on the vehicle 100. For example, the vehicle 100 may include a vehicle exhaust system 170 and an exhaust gas temperature sensor 180 arranged to measure a temperature of the vehicle exhaust. As discussed in further detail below, the active thermal management system 120 may also take into account the temperature of the vehicle exhaust when determining whether to activate the cooling system 130 of the vehicle 100.

Figure 2:
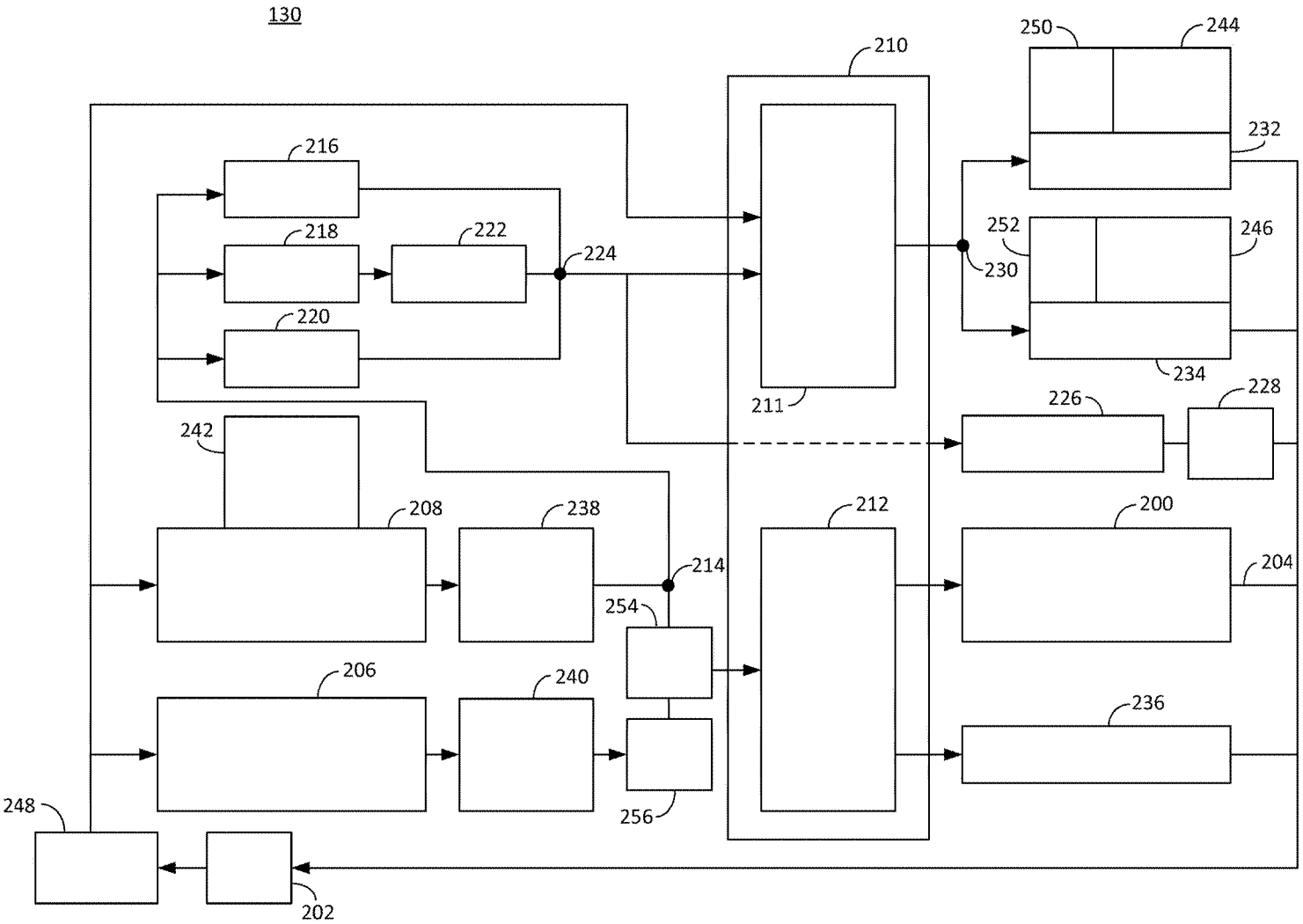
FIG. 2 is a block diagram of a cooling system for an active thermal management system, in accordance with an embodiment.

FIG. 2 is a block diagram of an exemplary cooling system 130 for the active thermal management system 120, in accordance with an embodiment. However, the active thermal management system 120 could be used with a wide variety of cooling systems 130 with varying cooling circuits.

The cooling system 130 includes a radiator 200 and a main pump 202 and fluid transmission lines connecting the radiator to various engine components. The main pump 202 circulates a liquid through the radiator 200 and through other engine components, as discussed in further detail below. The radiator 200 utilizes one or more of convection and thermal radiation to cool the liquid (hereinafter referred to as a coolant) passing there through.

Each line and arrow in FIG. 2 represents a path that the coolant takes through various engine components utilizing fluid transmission lines. As seen in FIG. 2, the output of the radiator 200, indicated by line 204 is connected to the main pump 202. The main pump 202 pumps the coolant to an engine block 206, a cylinder head 208 and an input to rotary valve 210. The rotary valve 210 may have two chambers 211 and 212 which are both controlled simultaneously by the controller 140. As seen in FIG. 2, the main pump 202 is connected to the chamber 211 of the rotary valve 210. The coolant, after passing through the cylinder head 204 and engine block 206, is mixed together at a point 214. The mixed coolant is sent to the chamber 212 of the rotary valve 210, a turbo 216, a high pressure exhaust gas recirculator valve (HP EGR valve) 218 and a low pressure (LP) EGR cooler 220. The coolant passing through the HP EGR 218 valve then passes through an exhaust throttle valve 222. The coolant passing through the turbo 216, the exhaust throttle valve 222 and the LP EGR 220 is combined at a point 224. The point 224 represents in intersection of fluid transmission lines. The combined coolant at 224 is sent to the rotary valve 210 and a heater core 226. The heater core 226 is a heat exchanger from coolant circuit to air cabin circuit, usually it is used to warm-up the air that warms up the cabin. As seen in FIG. 2, an auxiliary pump 228 is coupled to the output of the heater core 226 and aides the main pump 202 in circulating the coolant through the various vehicle components illustrated in FIG. 2. The auxiliary pump 228 may be used, for example, when the engine of the vehicle 100 is off and there is a flow request (e.g., a heater core request when the car is parked).

The rotary valves 210 is controlled by the controller 140. The chamber 212 is controlled by the controller 140 to maintain the inlet temperature equal to a target temperature. When chamber 212 is open, the point 230 can receive cold coolant flow from the radiator or hot coolant flow from point 224 according engine and transmission oil temperatures. The rotary valve 210 selectively couples one of the coolant output from the radiator 200, indicated by line 204 or the mixture of the combined coolant passed through the turbo 216, the exhaust throttle valve 222 and the LP EGR 220 indicated at point 224 to the output of the rotary valve 210, indicated by point 230. The coolant output from the rotary valve 210 is passed through an engine oil heater 232 and a transmission oil heater 234. The engine oil heater 232 and transmission oil heater 234 may be used to heat the engine oil and transmission oil, respectfully, during a warmup phase of the vehicle. The coolant output from the engine oil heater 232 and transmission oil heater 234 is connected to the output of the radiator 200 and the output of the auxiliary pump 228. The rotary valve 214 selectively couples the coolant input to the valve from the mixture of coolant passing through the cylinder head and engine block are indicated at point 214 to the radiator 200 or a radiator bypass line 236.

As illustrated in FIG. 2, the active thermal management system 120 further includes an engine out coolant temperature sensor 238, a block out coolant temperature sensor 240, an engine metal temperature sensor 242, an engine oil temperature sensor 244, a transmission oil temperature sensor 246 and an engine inlet temperature sensor 248. The engine inlet temperature sensor 248 measures the coolant temperature entering the engine. The engine out coolant temperature sensor 238 measures the temperature of the coolant exiting the cylinder head 208 and reports the temperature to the controller 140. Likewise, a block out coolant temperature sensor 240 measures the temperature of the coolant exiting the engine block 206 and reports the temperature to the controller 140. In one embodiment, for example, the engine out coolant temperature sensor 238, the block out coolant temperature sensor 240 and the engine inlet temperature sensor 248 may be attached to a fluid transmission line, as illustrated in FIG. 2. However, the temperature sensors could be mounted in a variety of ways.

The engine metal temperature sensor 242 is coupled to a metal component of the engine and reports the temperature to the controller 140. While the engine metal temperature sensor 242 is illustrated as being coupled to the cylinder head 208 in FIG. 2, the engine metal temperature sensor 242 could be coupled to any metal component of the engine of the vehicle 100.

The engine oil temperature sensor 244 measures a temperature of the engine oil and sends the result to the controller 140. The engine oil temperature sensor 244 is communicatively connected to the controller 140, though the connection is not illustrated in FIG. 2 for simplicity. An oil pump 250 may pump oil from the engine oil heater 232 causing the engine oil to pass by the engine oil temperature sensor 244. When a temperature of the engine oil is less than a temperature of the coolant, the engine oil heater 232, with the heater turned off, can be used to cool the coolant. Similarly, the transmission oil temperature sensor 246 measures a temperature of the transmission oil and sends the result to the controller 140. The transmission oil temperature sensor 246 is communicatively connected to the controller 140, though the connection is not illustrated in FIG. 2 for simplicity. An oil pump 252 may pump oil from the transmission oil heater 234 causing the transmission oil to pass by the transmission oil temperature sensor 246. When a temperature of the transmission oil is less than a temperature of the coolant, the transmission oil heater 234, with the heater turned off, can be used to cool the coolant.

Figure 3:
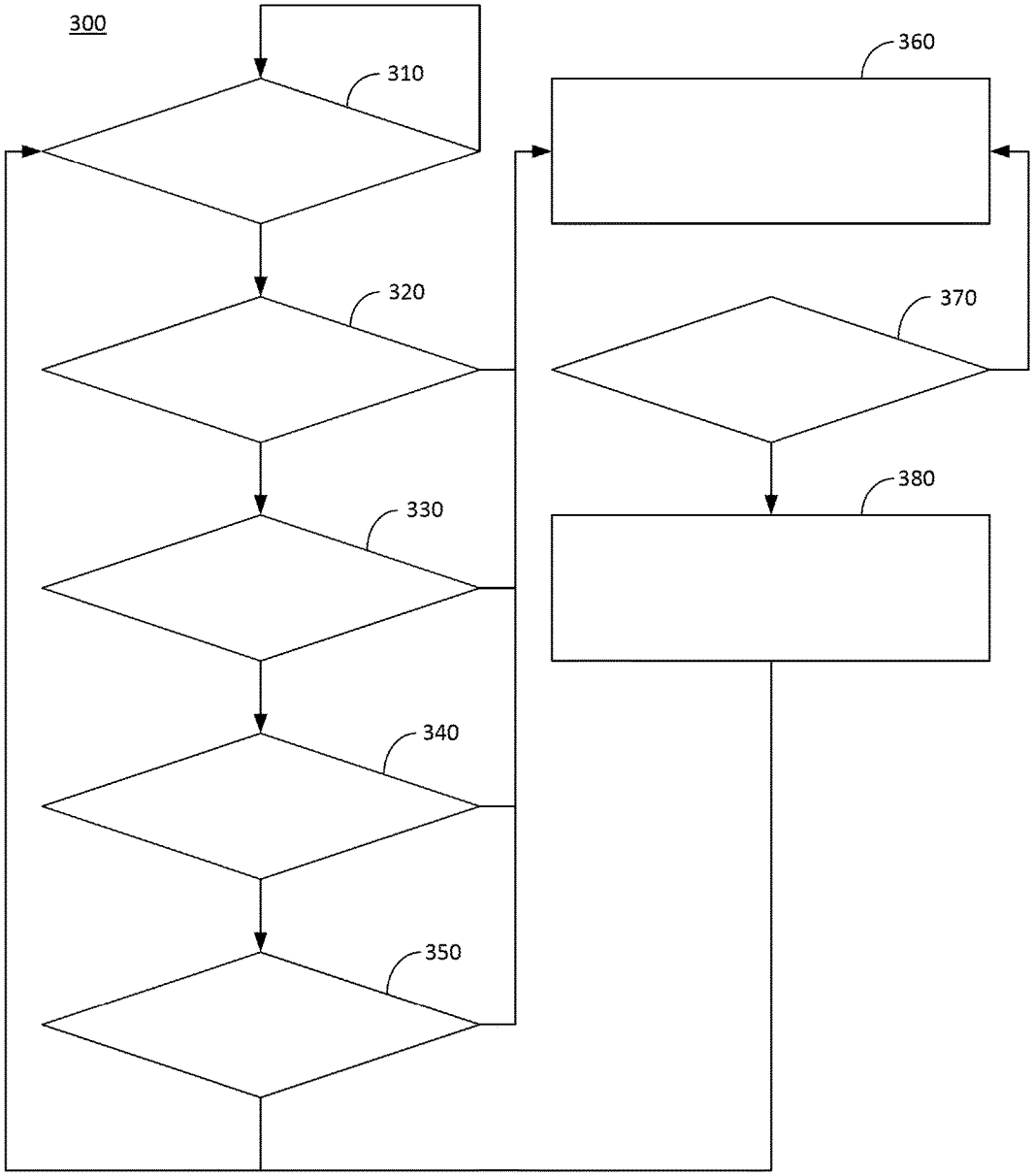
FIG. 3 is a flow diagram illustrating a method for operating the active thermal management system, in accordance with an embodiment.

FIG. 3 is a flow diagram illustrating a method 300 for operating the active thermal management system 120, in accordance with an embodiment. The method begins when the controller 140 determines that the vehicle has been placed in a tow/haul mode. (Step 310). As discussed above, a user can place the vehicle 100 into the tow/haul mode by utilizing the tow/haul interface 110. When the controller 140 determines that the vehicle is not in the tow haul mode, the controller 140 operates the cooling system normally.

In normal operation the controller 140 controls a coolant flow control valve 254 to reduce the coolant flow in the circuit. The flow reduction reduces a mechanical load on the main pump 202. The control sets the chamber 212 of the rotary valve 210 to raise an engine inlet coolant temperature to a higher than usual temperature to increase the engine temperature. A lower flow and higher temperature have a positive effect on combustion efficiency in the normal operation mode. The rotary valve 210 manages heat distribution (heater core, engine, oil coolers, etc.) according to CO2 efficiency by opening and closing the various valves of the system. During warm-up, the controller 140 controls the coolant flow control valve 254 to force zero flow during the warm-up to reduce heat loss. Likewise, the controller 140 controls a block rotary valve 256 to reduce the coolant flow in the engine block 206 during a warm-up phase to reduce heat loss.

When the controller 140 determines that the vehicle is in the tow haul mode, the controller 140 then determines if the temperature of the vehicle exhaust is greater than a predetermined temperature. (Step 320). As discussed above, an exhaust gas temperature sensor 180 sends temperature data for the exhaust gas temperature to the controller 140. In one embodiment, for example, the predetermined temperature may be five-hundred degrees Celsius (500° C.). However, the predetermined threshold for the exhaust gas temperature could vary depending upon stress thresholds for a particular vehicle.

When the temperature of the exhaust is lower than the predetermined threshold, the controller 140 determines if the temperature of the engine metal is above another predetermined threshold. (Step 330). As discussed above, an engine metal temperature sensor 242 sends the temperature of the engine metal to the controller 140. In one embodiment, for example, the predetermined threshold for the engine metal temperature may be one-hundred thirty degrees Celsius (130° C.). However, the predetermined threshold for the engine metal could vary depending upon stress thresholds for a particular vehicle.

When the temperature of the engine metal is lower than the predetermined threshold, the controller 140 determines if the temperature of the engine coolant is above another predetermined threshold. (Step 340). As discussed above, an engine out coolant temperature sensor 238 and a block out coolant temperature sensor 240 send their respective measured temperatures of the coolant to the controller 140. In one embodiment, for example, the predetermined threshold for the engine coolant output temperature may be one-hundred ten degrees Celsius (110° C.). However, the predetermined threshold for the engine coolant output temperature could vary depending upon stress thresholds for a particular vehicle.

When the engine coolant output temperature is lower than the predetermined threshold, the controller 140 determines if the temperature of the engine oil is above another predetermined threshold. (Step 350). As discussed above, an engine oil temperature sensor 244 and a transmission oil temperature sensor 246 sends their respective oil temperature to the controller 140. In one embodiment, for example, the predetermined threshold for the engine oil and transmission oil may be one-hundred forty degrees Celsius (140° C.). However, the predetermined threshold for the engine oil could vary depending upon stress thresholds for a particular vehicle.

When none of the exhaust temperature, engine metal temperature, engine coolant output temperature or engine oil temperature are above their respective predetermined thresholds, the controller 140 returns to Step 310 to continue monitoring the vehicle 100.

When any one or more of the exhaust temperature, engine metal temperature, engine coolant output temperature or engine oil temperature are above the predetermined threshold, the controller 140 operates one or more of the rotary valves 210 and 214 to allow coolant to flow from the radiator to the various engine components. (Step 360). By reacting to vehicle mode and the temperature thresholds discussed above, the system can better anticipate the cooling needs of the vehicle and avoid unwanted torque reduction or re-start of the engine in the case of key-off and heat soak. The controller can also reduce the inlet temperature target of the engine, causing the radiator to open more and force cold coolant flow in the oil heaters to further assist the vehicle 100 when in the tow/haul mode.

By triggering the cooling cycle when the vehicle 100 is in the tow/haul mode when any one of the sensors for the exhaust temperature, engine metal temperature, engine coolant output temperature or engine oil temperature register a temperature above a respective threshold, the active thermal management system 120 reduces temperature stress on the engine components of the vehicle 100 and reduces or eliminates the need for engine idle times at the end of a drive cycle.

The controller 140 then determines when all of the exhaust temperature, engine metal temperature, engine coolant output temperature and engine oil temperature are below respective predetermined low temperature thresholds. (Step 370). By requiring all of the exhaust temperature, engine metal temperature, engine coolant output temperature and engine oil temperature to be below respective predetermined low temperature thresholds, the controller 140 ensures that all of the engine components are operating at a temperature which reduces the stress on the respective engine component when the vehicle 100 is in the tow/haul mode. The predetermined low temperature thresholds may be, for example, twenty degrees less than the temperature limit for the respective component.

When one or more of the exhaust temperature, engine metal temperature, engine coolant output temperature and engine oil temperature are above their respective predetermined low temperature thresholds, the controller 140 continues to circulate coolant through the radiator 200 to the various engine components.

When all of the exhaust temperature, engine metal temperature, engine coolant output temperature and engine oil temperature are below their respective predetermined low temperature thresholds, the controller 140 causes the valves 210 and 214 to stop circulating coolant through the radiator 200. (Step 380). The controller 140 then returns to Step 310 to continue to monitor the engine components when the vehicle 100 remains in the tow/haul mode.

While at least one exemplary aspect has been presented in the foregoing detailed description of the invention, it should be appreciated that a vast number of variations exist. It should also be appreciated that the exemplary aspect or exemplary aspects are only examples, and are not intended to limit the scope, applicability, or configuration of the invention in any way. Rather, the foregoing detailed description will provide those skilled in the art with a convenient road map for implementing an exemplary aspect of the invention. It being understood that various changes may be made in the function and arrangement of elements described in an exemplary aspect without departing from the scope of the invention as set forth in the appended claims.

What is claimed is:

1. An active thermal management system for a vehicle, comprising:

an exhaust gas temperature sensor configured to output a temperature of exhaust gas of the vehicle;

an engine metal temperature sensor configured to output a temperature of engine metal of an engine of the vehicle;

an engine coolant output temperature sensor configured to output a temperature of coolant output from the engine of the vehicle;

an engine oil temperature sensor configured to output a temperature of engine oil of the vehicle;

a cooling system comprising:

a radiator configured to cool a coolant;

a plurality of fluid transmission lines configured to transport the coolant;

a main pump configured to circulate the coolant; and at least one valve; and a controller communicatively coupled to the exhaust gas temperature sensor, the engine metal temperature sensor, the engine coolant output temperature sensor, the engine oil temperature sensor and the at least one valve, the controller configured to:

determine when the vehicle is in a tow/haul mode;

operate, when the vehicle is in the tow/haul mode, the at least one valve to circulate coolant through the radiator when at least one of the temperature of the exhaust gas is greater than a predetermined high exhaust gas temperature, the temperature of engine metal of the vehicle is greater than a predetermined high engine metal temperature, the temperature of the coolant output from the engine of the vehicle is greater than a predetermined high coolant output temperature, and the temperature of the engine oil of the vehicle is greater than a predetermined high engine oil temperature; and operate, when the vehicle is in the tow/haul mode, the at least one valve to bypass the radiator when all of the temperature of the exhaust gas is lower than a predetermined low exhaust gas temperature, the temperature of engine metal of the vehicle is lower than a predetermined low engine metal temperature, the temperature of the coolant output from the engine of the vehicle is lower than a predetermined low coolant temperature, and the temperature of the engine oil of the vehicle is lower than a predetermined low engine oil temperature.

2. The active thermal management system of claim 1, wherein the vehicle further comprises:

a cylinder head; and an engine block, wherein the plurality of fluid transmission lines couple the coolant output from the radiator to a coolant input to the cylinder head, couple the coolant output from the radiator to a coolant input to the engine block, mix coolant output from the cylinder head and coolant output from the engine block, couple the mixed coolant output from the cylinder head and the engine block to the at least one valve.

3. The active thermal management system of claim 2, wherein the vehicle further comprises:

a turbo;

a high pressure exhaust gas recirculator valve;

a throttle; and a low pressure exhaust gas recirculator cooler, wherein the plurality of fluid transmission lines couple the mixed coolant output from the cylinder head and the engine block to a coolant input of the turbo, couple the mixed coolant output from the cylinder head and the engine block to a coolant input of the high pressure exhaust gas recirculator valve, couple the mixed coolant output from the cylinder head and the engine block to a coolant input of the low pressure exhaust gas recirculator cooler, couple a coolant output of the high pressure exhaust gas recirculator valve to a coolant input of the throttle, and mix the coolant output of the turbo, the coolant output of the throttle and the coolant output of the low pressure exhaust gas recirculator cooler.

4. The active thermal management system of claim 3, wherein the at least one valve comprises a first valve and a second valve, wherein the first valve comprises a first input is coupled to the mixed coolant output from the cylinder head and the engine block, a first output is coupled to a coolant input of the radiator and a second output is coupled to the radiator bypass.

5. The active thermal management system of claim 4, wherein the second valve comprises a first input coupled to the output of the radiator, a second input coupled to the mixed coolant output of the turbo, the coolant output of the throttle and the coolant output of the low pressure exhaust gas recirculator, and a first output.

6. The active thermal management system of claim 5, wherein the vehicle further comprises:

an engine oil heater; and a transmission oil heater, wherein the plurality of fluid transmission lines couple the first output of the second valve to a coolant input of the engine oil heater and couple the first output of the second valve to a coolant input of the transmission oil heater.

7. The active thermal management system of claim 6, wherein the plurality of fluid transmission lines couple a coolant output of the engine oil heater and a coolant output of the transmission oil heater to the coolant output from the radiator and to the radiator bypass.

8. The active thermal management system of claim 1, wherein the predetermined high exhaust gas temperature is five-hundred degrees Celsius.

9. The active thermal management system of claim 1, wherein the predetermined high engine metal temperature is one-hundred thirty degrees Celsius.

10. The active thermal management system of claim 1, wherein the predetermined high coolant output temperature is one-hundred ten degrees Celsius.

11. The active thermal management system of claim 1, wherein the predetermined high engine oil temperature is one-hundred forty degrees Celsius.

12. A vehicle, comprising:

an exhaust gas temperature sensor configured to output a temperature of exhaust gas of the vehicle;

an engine metal temperature sensor configured to output a temperature of engine metal of an engine of the vehicle;

an engine coolant output temperature sensor configured to output a temperature of coolant output from the engine of the vehicle;

an engine oil temperature sensor configured to output a temperature of engine oil of the vehicle;

a cooling system comprising:

a radiator configured to cool a coolant;

a plurality of fluid transmission lines configured to transport the coolant;

a main pump configured to circulate the coolant; and at least one valve; and a controller communicatively coupled to the exhaust gas temperature sensor, the engine metal temperature sensor, the engine coolant output temperature sensor, the engine oil temperature sensor and the at least one valve, the controller configured to:

determine when the vehicle is in a tow/haul mode;

operate, when the vehicle is in the tow/haul mode, the at least one valve to circulate coolant through the radiator when at least one of the temperature of the exhaust gas is greater than a predetermined high exhaust gas temperature, the temperature of engine metal of the vehicle is greater than a predetermined high engine metal temperature, the temperature of the coolant output from the engine of the vehicle is greater than a predetermined high coolant output temperature, and the temperature of the engine oil of the vehicle is greater than a predetermined high engine oil temperature; and operate, when the vehicle is in the tow/haul mode, the at least one valve to bypass the radiator when all of the temperature of the exhaust gas is lower than a predetermined low exhaust gas temperature, the temperature of engine metal of the vehicle is lower than a predetermined low engine metal temperature, the temperature of the coolant output from the engine of the vehicle is lower than a predetermined low coolant temperature, and the temperature of the engine oil of the vehicle is lower than a predetermined low engine oil temperature.

13. The vehicle of claim 12, wherein the vehicle further comprises:

a cylinder head; and an engine block, wherein the plurality of fluid transmission lines couple the coolant output from the radiator to a coolant input to the cylinder head, couple the coolant output from the radiator to a coolant input to the engine block, mix coolant output from the cylinder head and coolant output from the engine block, couple the mixed coolant output from the cylinder head and the engine block to the at least one valve.

14. The vehicle of claim 13, wherein the vehicle further comprises:

a turbo;

a high pressure exhaust gas recirculator valve;

a throttle; and a low pressure exhaust gas recirculator cooler, wherein the plurality of fluid transmission lines couple the mixed coolant output from the cylinder head and the engine block to a coolant input of the turbo, couple the mixed coolant output from the cylinder head and the engine block to a coolant input of the high pressure exhaust gas recirculator valve, couple the mixed coolant output from the cylinder head and the engine block to a coolant input of the low pressure exhaust gas recirculator cooler, couple a coolant output of the high pressure exhaust gas recirculator valve to a coolant input of the throttle, and mix the coolant output of the turbo, the coolant output of the throttle and the coolant output of the low pressure exhaust gas recirculator cooler.

15. The vehicle of claim 14, wherein the at least one valve comprises a first valve and a second valve, wherein the first valve comprises a first input is coupled to the mixed coolant output from the cylinder head and the engine block, a first output is coupled to a coolant input of the radiator and a second output is coupled to the radiator bypass.

16. The vehicle of claim 15, wherein the second valve comprises a first input coupled to the output of the radiator, a second input coupled to the mixed coolant output of the turbo, the coolant output of the throttle and the coolant output of the low pressure exhaust gas recirculator, and a first output.

17. The vehicle of claim 16, wherein the vehicle further comprises:

an engine oil heater; and a transmission oil heater, wherein the plurality of fluid transmission lines couple the first output of the second valve to a coolant input of the engine oil heater and couple the first output of the second valve to a coolant input of the transmission oil heater.

18. The vehicle of claim 17, wherein the plurality of fluid transmission lines couple a coolant output of the engine oil heater and a coolant output of the transmission oil heater to the coolant output from the radiator and to the radiator bypass.

19. The vehicle of claim 12, wherein the predetermined high exhaust gas temperature is five-hundred degrees Celsius, the predetermined high engine metal temperature is one-hundred thirty degrees Celsius, the predetermined high coolant output temperature is one-hundred ten degrees Celsius, and the predetermined high engine oil temperature is one-hundred forty degrees Celsius.

20. A method for operating an active thermal management system for a vehicle, comprising:

determining, by a controller, when the vehicle is in a tow/haul mode;

operating, when the vehicle is in the tow/haul mode, at least one valve to circulate coolant through a radiator when at least one of a temperature of an exhaust gas is greater than a predetermined high exhaust gas temperature, a temperature of engine metal of the vehicle is greater than a predetermined high engine metal temperature, a temperature of the coolant output from an engine of the vehicle is greater than a predetermined high coolant output temperature, and a temperature of an engine oil of the vehicle is greater than a predetermined high engine oil temperature; and operating, when the vehicle is in the tow/haul mode, the at least one valve to bypass the radiator when all of the temperature of the exhaust gas is lower than a predetermined low exhaust gas temperature, the temperature of engine metal of the vehicle is lower than a predetermined low engine metal temperature, the temperature of the coolant output from the engine of the vehicle is lower than a predetermined low coolant temperature, and the temperature of the engine oil of the vehicle is lower than a predetermined low engine oil temperature.

* * * * *